US007828945B2

(12) United States Patent
Yamamoto

(10) Patent No.: US 7,828,945 B2
(45) Date of Patent: Nov. 9, 2010

(54) PLATING BARREL, BARREL PLATING APPARATUS AND DRAIN EQUIPMENT

(75) Inventor: Wataru Yamamoto, Tokyo (JP)

(73) Assignee: Yamamoto-MS Co., Ltd, Shibuya-Ku, Tokyo (JP)

( * ) Notice: Subject to any disclaimer, the term of this patent is extended or adjusted under 35 U.S.C. 154(b) by 876 days.

(21) Appl. No.: 11/476,762

(22) Filed: Jun. 29, 2006

(65) Prior Publication Data

US 2006/0243586 A1 Nov. 2, 2006

Related U.S. Application Data

(62) Division of application No. 10/855,615, filed on May 28, 2004, now abandoned.

(30) Foreign Application Priority Data

Jun. 18, 2003 (JP) ..... 2003-172982

(51) Int. Cl.
*B23H 7/26* (2006.01)

(52) U.S. Cl. ..... 204/297.11; 204/297.01

(58) Field of Classification Search ..... 204/193, 204/201, 212, 213, 275.1, 297.01, 297.11
See application file for complete search history.

(56) References Cited

U.S. PATENT DOCUMENTS

| | | | | |
|---|---|---|---|---|
| 2,500,861 A | | 3/1950 | Phillips | |
| 3,282,819 A | | 11/1966 | Hovanic | |
| 4,078,297 A | | 3/1978 | Marulli | |
| 4,257,864 A | | 3/1981 | Gacki | |
| 5,057,202 A | * | 10/1991 | Maitino et al. | 204/212 |
| 5,326,403 A | | 7/1994 | Iwanaga | |
| 6,228,230 B1 | * | 5/2001 | Li et al. | 204/222 |
| 6,322,685 B1 | | 11/2001 | Kang et al. | |
| 2002/0000371 A1 | * | 1/2002 | Mishima et al. | 204/199 |

FOREIGN PATENT DOCUMENTS

| | | | |
|---|---|---|---|
| JP | 2001334272 A | * | 12/2001 |
| JP | 2002-241997 | | 8/2002 |
| WO | WO 96/37638 | | 11/1996 |

OTHER PUBLICATIONS

Patent Abstracts of Japan, vol. 1997, No. 12, Dec. 25, 1997, JP 9 203000 A, Aug. 5, 1997, Sumitomo Special Metals.
Patent Abstracts of Japan, vol. 1997, No. 12, Dec. 25, 1997, JP 9 202997 A, Aug. 5, 1997, Sumitomo Special Metals.

* cited by examiner

*Primary Examiner*—Luan V Van
(74) *Attorney, Agent, or Firm*—Squire, Sanders & Dempsey L.L.P.

(57) ABSTRACT

The present invention can provide 1 which barrel plating apparatus where a plating barrel has permeable holes and slits in a size of order of micrometers on the wall thereof. The plating barrel is fabricated with porous plastic materials which have permeable holes and slits to the plating liquid and no piece materials to be plated are dropped thereof. Further advantage of the present invention is to provide a drain tool to drain the plating liquid L staying in the plating barrel.

2 Claims, 5 Drawing Sheets

PLATING BARREL, BARREL PLATING APPARATUS AND DRAIN EQUIPMENT

REFERENCE TO RELATED APPLICATIONS

This is a Division of application Ser. No. 10/855,615 filed May 28, 2004. The disclosure of the prior application is hereby incorporated by reference herein in its entirety.

FIELD OF THE INVENTION

The present invention relates to plating barrels, barrel plating apparatuses and drain tools to drain out plating liquid staying in the plating barrels.

BACKGROUND OF THE INVENTION

For the purpose of plating small pieces of materials, the barrel plating technology has been used. In this plating process, a bunch of small pieces of materials is put in a plating barrel (that is a barrel shape container or a cylindrical shape container) and the barrel is immersed in the plating liquid in order to plate the small pieces of materials (for example, see the reference 1). In order to keep the plating liquid comes in and goes out from the plating barrel without intrusion, many holes or slits are made in the surrounding surface of the plating barrel. The size and the shape of the holes (including slits and meshes) should be designed in such a way that no pieces of the material to be plated fall out from the plating barrel.

Reference 1:

Japanese Published Patent, 2002-241997, A (2002)

In the conventional technologies, mechanical drill machines and drill lasers are used to make the holes, slits or meshes in proper control of physical sizes thereof. However the minimum sizes of the holes, slits and meshes by such mechanical means are limited by the order of 0.1 mm and are not possible down to 0.001 mm. This is true even in the case when the plating barrel is made of metal wire cloth.

For the piece parts plating, small sizes of holes, slits or meshes for the plating barrels are required since the sizes of piece parts become smaller and smaller in the advance of technologies. The larger size of the holes, slits or meshes of the plating barrels cannot hold the piece parts in the barrel plating process. The mechanical process to make holes, slits or meshes takes long time and results in high cost fabrication.

BRIEF SUMMARY OF THE INVENTION

The present invention has an advantage to provide a plating barrel which has much finer holes, slits or meshes as an order of 1 micro meter and has another advantage such that the plating barrel can be easily fabricated with low cost. The present invention has further advantage to provide a drain tool to drain out the plating liquid staying in such a plating barrel.

The function of the plating barrel regarding to the present invention is to accommodate the piece parts to be plated and is to be immersed in the plating liquid. The plating barrel is formed in a mold of porous plastic that has a micro skeleton texture. The porous plastic is made by sintering the crashed plastic chips under thermal treatment.

The plating barrel as made of the porous plastic has permeable holes that allow the plating liquid to come in or go out from the inside of the plating barrel, wherein the permeable holes are an order of micro meters. Therefore it is possible to plate the piece parts that have the size of an order of micro meters as well. No mechanical fabrication process to open holes, slits or meshes is required and therefore the fabrication of the plating barrel is easy and requires only low cost. The mother materials for the porous plastic are polyethylene, polypropylene, olefin resin products, polyester hydrates are used.

The present invention has further advantage to provide the plating capability of small pieces such that a rotation mechanism is attached to the plating barrel and a cathode and an anode are installed in the plating barrel for the purpose of electroplating. Therefore, the present invention serves electroplating operation when DC electricity is applied with rotating the plating barrel.

Due to the permeable micro holes of the porous plastic, it is possible to plate for the small pieces in sizes of an order of micro meter.

The drain tool regarding the present invention is to drain out the plating liquid in the plating barrel. The present invention has an advantage to drain the plating liquid out by means of suction which has featuring constructions such as a plating barrel holder and an outlet for exhausting the plating liquid.

The present invention of the drain tool has an advantage to exhaust the plating liquid in the plating barrel in a quick manner so that the time for the plating process is easily managed and controlled.

DETAILED DESCRIPTION OF THE INVENTION

The detail technologies of the present invention such as construction, function, performance and effects are explained in the following with referring to drawings.

Figure 1:
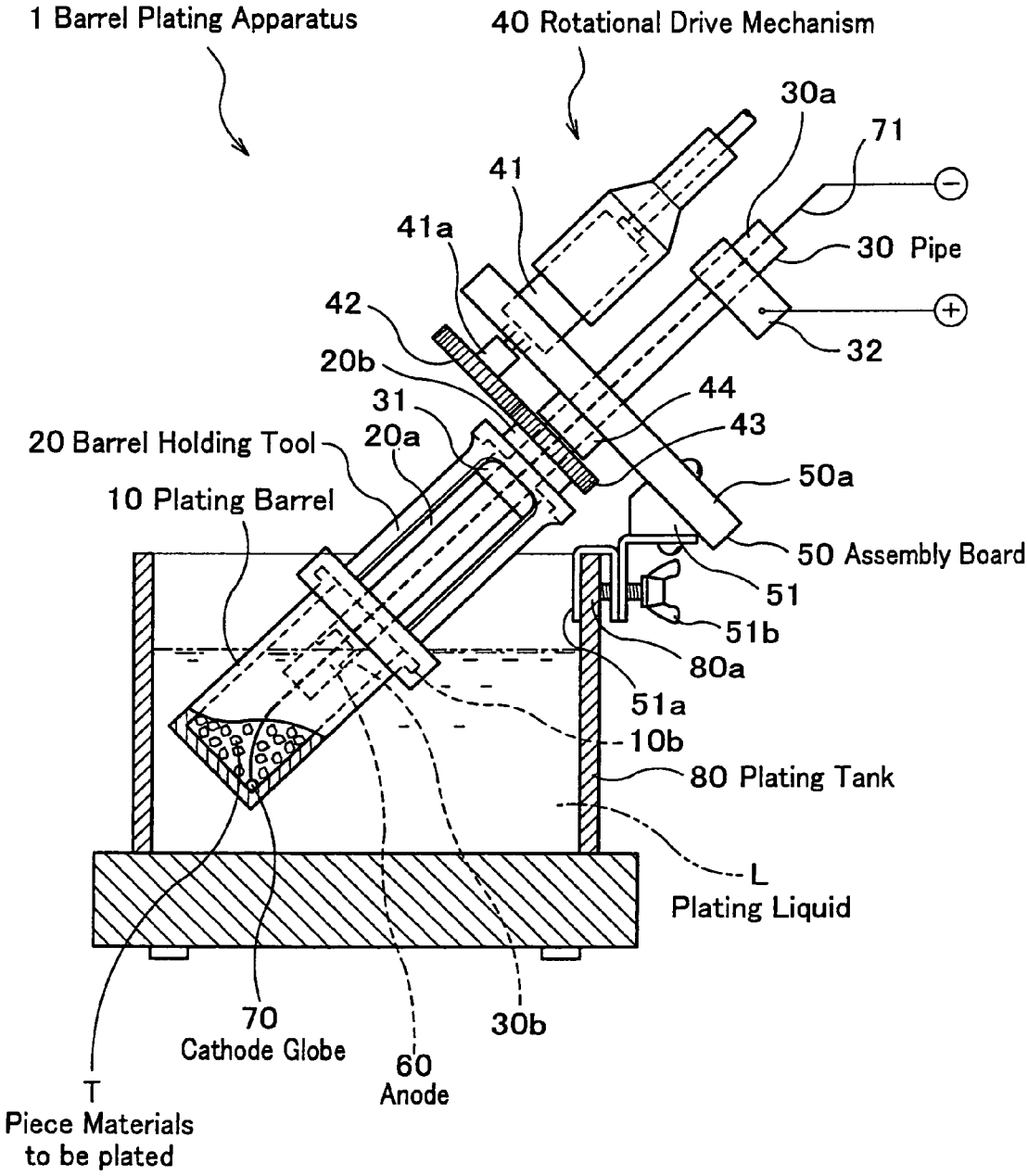
FIG. 1 is a cross sectional drawing that shows a cut-away view of the barrel plating apparatus of the present invention.
Figure 2:
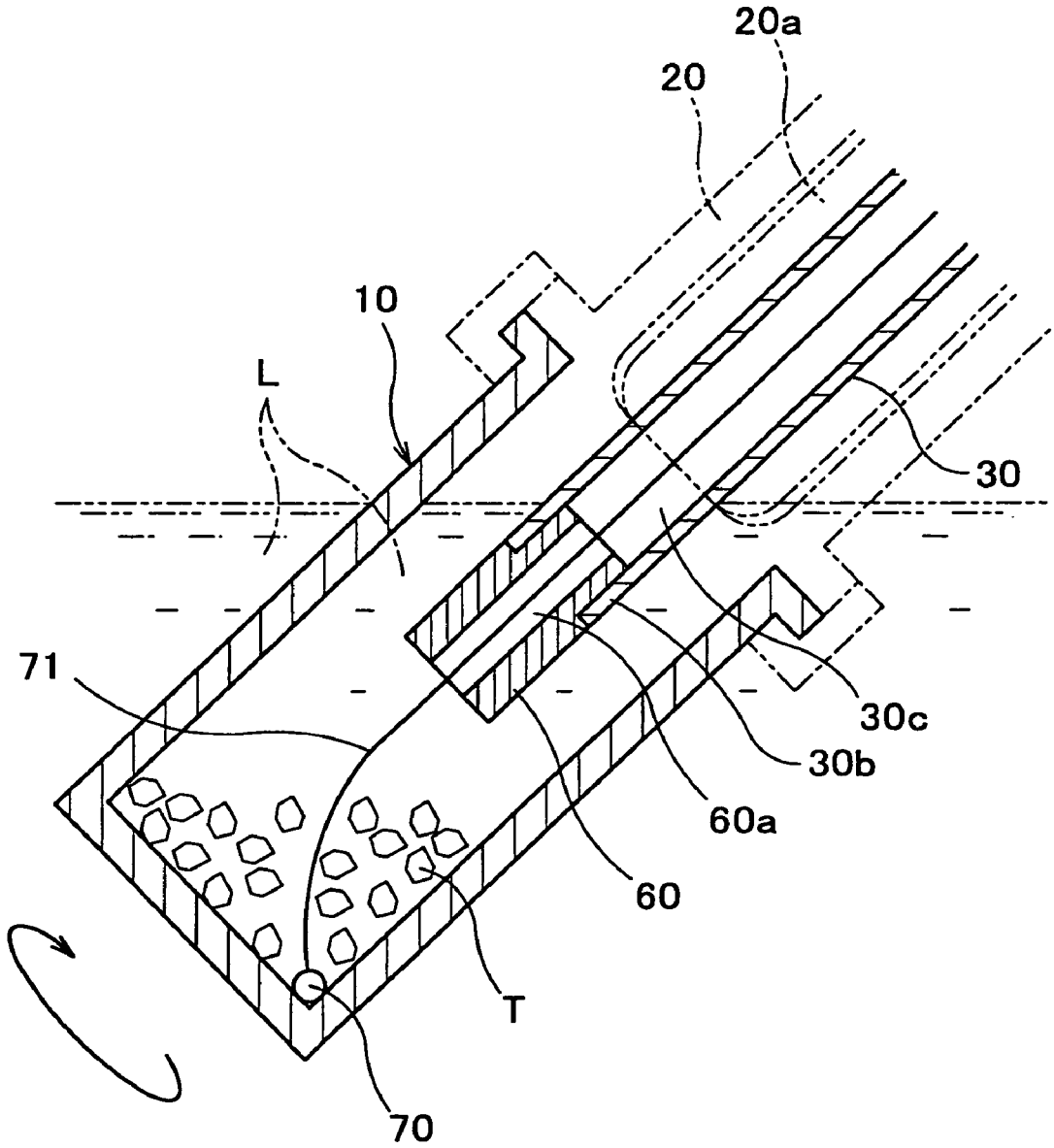
FIG. 2 is a cross sectional drawing that shows a zoom up view of the plating barrel 10 of the barrel plating apparatus of the present invention.

FIG. 1 and FIG. 2 show the plating barrel 10 and the barrel plating apparatus 1 regarding the present invention. FIG. 1 shows a cut-away view of a major portion of the plating barrel 10 and FIG. 2 shows a zoom up cross sectional view of the plating barrel 10.

The overall construction of the barrel plating apparatus 1 of the present invention is shown in FIG. 1. The barrel plating apparatus 1 comprises a plating barrel 10 accommodating piece materials T to be plated, a barrel holding tool 20, a pipe 30 that holds the barrel holding tool 20 and rotates therewith, a rotational drive mechanism 40 that rotates the barrel holding tool 20, an assembly board 50 to which the pipe 30 and the rotational drive mechanism 40 are assembled, an anode 60 and a cathode globe 70 which are installed in plating barrel 10 and a plating tank 80 which keeps the plating liquid L therein.

Figure 3:
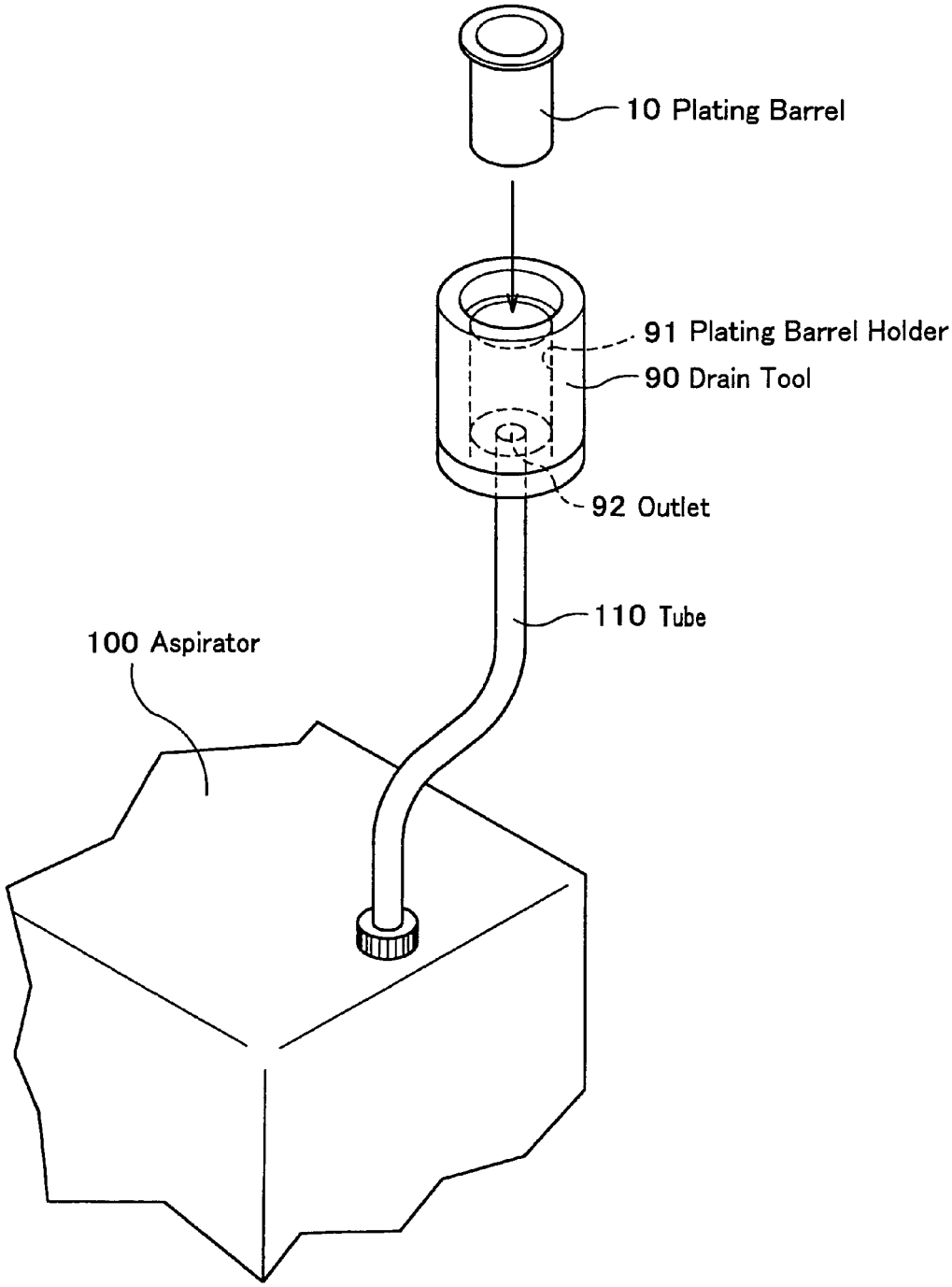
FIG. 3 is a perspective drawing that shows the drain tool and the relevant tools.
Figure 4:
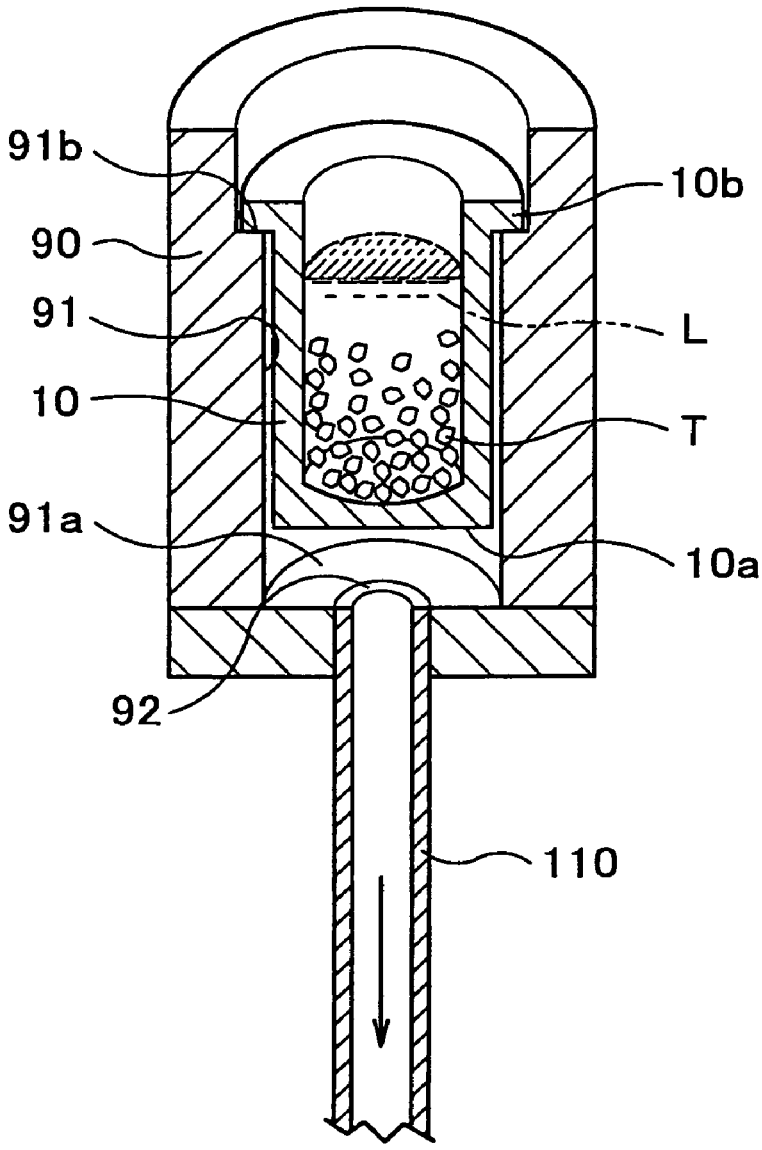
FIG. 4 is a cross sectional drawing that shows a zoom up view of the drain tool shown in FIG. 3.

The plating barrel 10 has a cylindrical shape with a closed bottom and an open top which has a brim portion 10*b* which is held by the barrel holder 91 at the stopper 91*b* of the drain tool 90 (see FIG. 3 and FIG. 4).

The plating barrel 10 can be mounted to and dismounted from the barrel holding tool 20. The plating barrel 10 is mounted to the barrel holder tool 20 when the plating barrel 10 is used for the plating process. The piece materials T to be plated (that is, piece parts to be plated) are put into and taken out from the plating barrel 10 before and after the plating process are done, respectively. The piece parts are, for example, IC chips, surface mount electronic devices such as resistors, capacitors and inductors, small dimensional mechanical parts made of ceramics, glasses or plastics, micro particle metals, etc.

The plating barrel is made of the porous plastic. The permeability of the porous plastic to the plating liquid L is caused by the skeleton texture of the crashed plastic chips which are thermally sintered. No fabric threads or furry surfaces are formed and therefore the piece materials T to be plated are not caught by, clutched to or stuck onto the surface of the porous plastic. The size of permeable holes or slits made in the porous plastic is smaller than the physical size of the piece materials T to be plated. Therefore no piece materials T are dropped off through the permeable holes or slits from the paling barrel while the plating process goes on. Neither piece materials T are captured by such permeable holes or slits. The porous plastic forms the barrel shape in a molding process, therefore no machining process such as drilling holes or barrel shaping is necessary. This provides a simple manufacturing process of the plating barrels. For the electroplating, it is necessary the piece materials T are contacting to the cathode plates. For this purpose, danglers work for the cathode electrical contact to the piece materials T. Since no piece materials T are caught by the porous plastic or captured by the permeable holes or slits, the electric supply by the dangler to the piece materials T are not shut off.

The barrel holding tool 20 is made by a hollow cylinder which has two open ends and plural side windows 20*a* to let the plating liquid L come out from or go into the plating barrel 10. The plural side windows 20*a* work to purge the gases generated from the plating liquid L and staying in the plating barrel 10 in the plating process. The barrel holding tool 20 is fixed to a ring 31 seized by the pipe 30 at the upper end 20*b* and can rotate with the rotation of the pipe 30. The upper end 20*b* is fixed to the gear 43, that is, a part of the rotational drive mechanism 40 by fixing means such as screws.

The pipe 30 is held by the assembly board 50 and penetrates therethrough. The pipe 30 is made of copper, stainless steel or other electrical conductive metals and coated by insulating material such as Teflon®. An electrical connection 32 which is connected to and anodic DC voltage is attached to the upper portion 30*a* of the pipe 30. The lower portion 30*b* of the pipe 30 is projected to the inside of the plating barrel 10.

The rotational drive mechanism 40 is composed of a motor 41, a gear 42 attached to rotational axis 41*a* of the motor 41, another gear 43 meshing to the gear 42. The motor 41 is fixed to the assembly board 50 by screws. The pipe 30 is inserted into a center hole of the gear 43 which can freely rotate around the pipe 30. According to the mechanism of this rotational drive mechanism 40, the rotational axis 41*a* and gears 42 and 43 are rotated by the motor 41. Then the barrel holding tool 20 which is fixed to the gear 43 rotates. There is a ring spacer 44 between the gear 43 and the assembly board 50. The pipe 30 is inserted to the ring spacer 44 that is fixed to the pipe 30 by screws.

The assembly board 50 is made, for example, of acrylic plastic and formed in a rectangular of which one side, called a lower side 50*a*, is fixed to the upper portion 80*a* of the plating tank 80 by a mount 51 with a screw. The mount 51 composes of a clamp 51*a* which meets the upper portion 80*a* of the plating tank 80 and a wing bolt 51*b* by which the mount 51 is fixed to the tank. The assembly board 50 is fixed to the plating tank in a 45 degree tilting angle by screws so that the rotational drive mechanism 40 locates above the plating tank 80.

As shown in FIG. 2, the anode 60 is made of copper, nickel, etc. and formed in a cylindrical shape. The anode 60 is inserted and fixed to the end of the pipe 30. The inner hole 60*a* of the anode 60 is continued to the hollow space 30*c* of the pipe 30. The cathode cable 71 is inserted in inner hole 60*a*, the hollow space 30*c* of the anode 60 and the pipe 30 as shows in FIG. 1. At the end, the cathode cable 71 is connected to the cathode voltage terminal of the DC power (not shown in figures).

As shown in FIG. 2, a cathode globe 70 is put into the bottom of the plating barrel 10 and can electrically contact with the piece materials T staying in the bottom of the plating barrel. The electricity is supplied to the cathode globe 70 through a cathode cable 71 on which an insulator is coated. The other end of the cathode cable is connected to the cathode port of an electric power supplier (not shown in figures). The cathode cable 71 is placed through the inner hole 60*a* of the anode 60 and hollow space 30*c* of the pipe 30.

The plating tank 80 is made, for example, of transparent acrylic plastic and the copper iodized solution, nickel iodized solution, etc. is used for the plating liquid L.

By using the barrel plating apparatus 1 as describe above, the plating process is carried out as follows. The piece materials T to be plated are put in the plating barrel 10 which is immersed into the plating liquid L staying in the plating tank 80. The plating barrel 10 is rotated with the barrel holding tool 20 by rotating the motor 41. The DC power is connected to the anode 60 attached to the pipe 30 and the cathode globe 7 though cathode cable 71 extending to the inside of the plating barrel 10. Then, electroplating is done for the piece materials T which is stored in the plating barrel 10.

Figure 5:
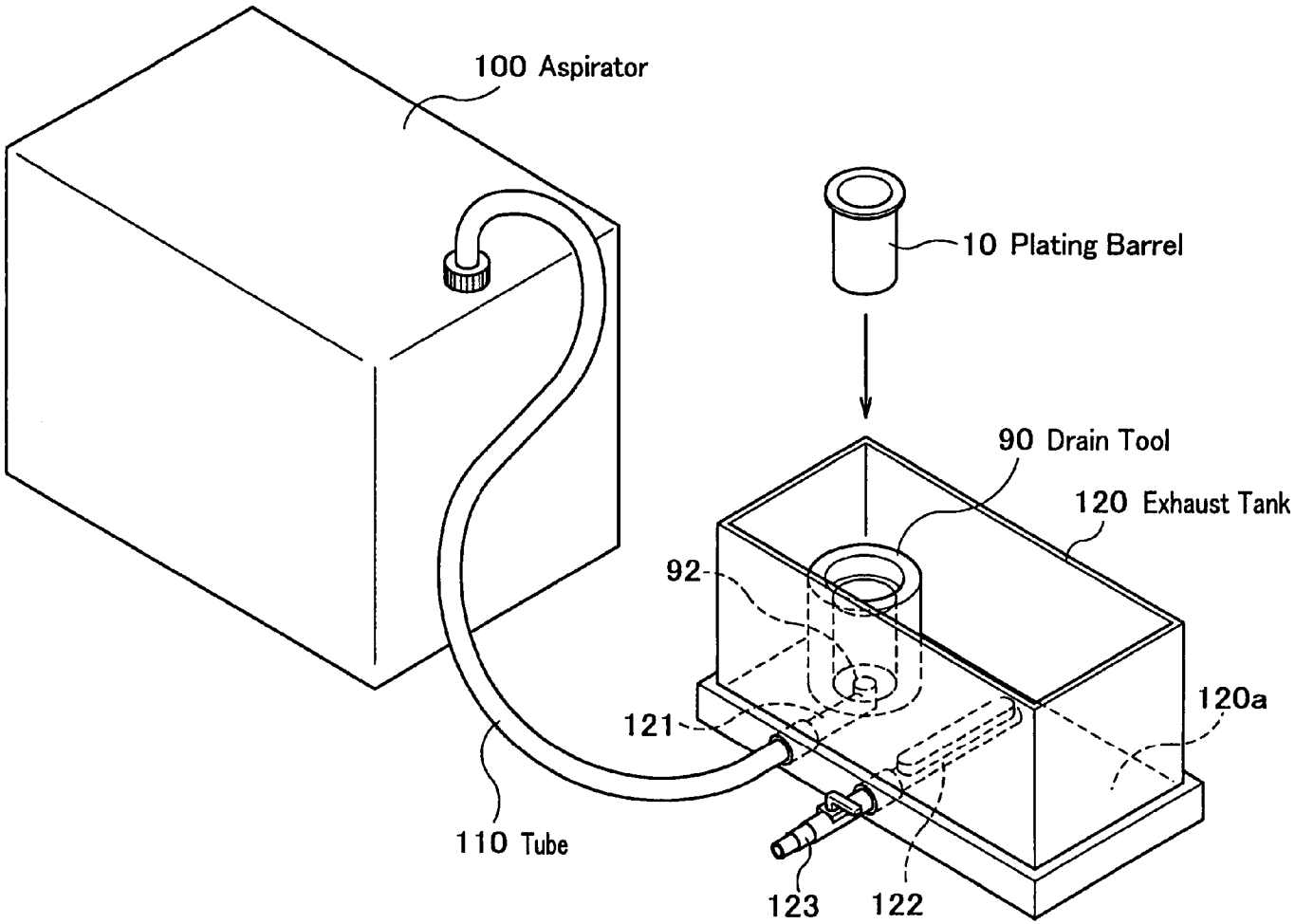
FIG. 5 is a perspective drawing that shows the installation of the drain tool in the exhaust tank.

The drain tool 90 that drains out the plating liquid L in the plating barrel 10 is explained in reference to FIG. 3 to FIG. 5. FIG. 3 shows the drain tool 90 and the relevant tools. FIG. 4 shows the cut away view of the drain tool 90. FIG. 5 shows the installation of the drain tool 90 to an exhaust tank 120.

The drain tool 90 is used before taking out the piece materials T in the plating barrel 10 after plating process has been over, especially is used to exhaust out the plating liquid L staying in the plating barrel 10. The drain tool 90 has a cylindrical form with an open cut in the upper end and has a bottom in the lower end. A plating barrel holder 91 has a space between the bottom 10*a* of the plating barrel 10 and the bottom 91*a* of the plating barrel holder 91.

At the upper portion of the plating barrel holder 91, a stopper 91*b* is formed to meet the brim portion 10*b* of the plating barrel 10. At the bottom of the drain tool 90, an outlet 92 to which a tube 110 linked to an aspirator 100 is inserted is formed. The aspirator 100 and the tube 110 work as an aspirating means.

When it is necessary to drain out the plating liquid L in the plating barrel 10, the plating barrel 10 is inserted in the plating barrel holder 91 in the drain tool 90. The plating liquid L in the plating barrel 10 can be quickly and easily aspirated by operating the aspirator 100. The advantage of quick exhaust of plating liquid L is that the time when piece materials T are immersed in the plating liquid L is short therefore no stains are made on the plating surfaces of the piece materials T since the electrolytic plating solution is quickly removed off from the surface of the piece materials T. The removal of such solution can be more effectively done when the rinsing water is sprinkled over the piece materials T during when the aspirator 100 works.

As shown in FIG. 5, the drain tool 90 can be used in attaching to the exhaust tank 120. In this case, the drain tool 90 is fixed to the bottom 120*a* of the exhaust tank 120. The first drain channel 121 is made extending from the outlet 92 of the drain tool 90 on the bottom 120*a* to the base outlet to which the tube 110 is connected. The second drain channel 122 to drain out the plating liquid L spilled out or overflowing is made in the bottom 120*a* of the exhaust tank 120. A tap 123 is attached to the base outlet of the second drain channel 122.

Although there have been disclosed what are the patent embodiment of the invention, it will be understood by person skilled in the art that variations and modifications may be made thereto without departing from the scope of the invention, which is indicated by the appended claims.

For example, the plating barrel 10 in the previous embodiment has a cylindrical shape but can be other shapes such as polygon columns. For such shapes, the plating barrel holder 91 is formed to meet such shapes. For the present embodiment shown in FIG. 2, the anode 60 is present inside of the plating barrel 10. However, it possible to put the anode outside the plating barrel 10 since the plating barrel 10 is immersed in the electrolysis plating liquid L as called plating liquid L. The present embodiment shows the case where electroplating is carried out, however the plating barrel 10 of the barrel plating apparatus regarding the present invention can be used for electroless wet plating as well.

As have been explaining, the present invention can provide a barrel plating apparatus 1 where a plating barrel 10 which has permeable holes and slits in a size of micrometers on the wall gaps is used. Another advantage of the present invention is the ease of fabrication of such plating barrel 10 due to the use of porous plastic materials. Further advantage of the present invention is to provide a drain tool 90 to drain the plating liquid L staying in the plating barrel 10 thereout.

What is claimed is:

1. A drain tool that drains out liquid staying in a plating barrel, said drain tool comprising:

a plating barrel holder that holds the plating barrel; and an outlet that is communicated with said plating barrel holder, wherein the liquid staying in said plating barrel is aspirated by an aspirating means, wherein the plating barrel is configured to accommodate piece materials to be plated, wherein the plating barrel comprises a molded porous plastic, wherein a space is formed between a bottom of the plating barrel and a bottom of the plating barrel holder, and wherein an upper portion of the barrel holding tool forms a stopper to meet a brim portion of the plating barrel.

2. A drain tool that drains out liquid staying in a plating barrel, said drain tool comprising:

a plating barrel holder that holds the plating barrel; and an outlet that is communicated with said plating barrel holder, wherein the liquid staying in said plating barrel is aspirated by an aspirating means, wherein the plating barrel is configured to accommodate piece materials, wherein the plating barrel comprises a molded porous plastic formed by sintering crashed plastic chips under thermal treatment, wherein a space is formed between a bottom of the plating barrel and a bottom of the plating barrel holder, and wherein an upper portion of the barrel holding tool forms a stopper to meet a brim portion of the plating barrel.

* * * * *